United States Patent [19]

Feenstra et al.

[11] Patent Number: 4,465,147

[45] Date of Patent: Aug. 14, 1984

[54] METHOD AND MEANS FOR CONTROLLING THE COURSE OF A BORE HOLE

[75] Inventors: Robijn Feenstra; Anthony W. Kamp, both of Rijswijk, Netherlands

[73] Assignee: Shell Oil Company, Houston, Tex.

[21] Appl. No.: 462,266

[22] Filed: Jan. 31, 1983

[30] Foreign Application Priority Data

Feb. 2, 1982 [GB] United Kingdom ..... 8202987

[51] Int. Cl.[3] ..... E21B 7/08

[52] U.S. Cl. ..... 175/73; 175/325; 175/61

[58] Field of Search ..... 175/61, 73, 76, 320, 175/325; 166/241; 308/4 A

[56] References Cited

U.S. PATENT DOCUMENTS

| | | | |
|---|---|---|---|
| 2,712,434 | 7/1955 | Giles et al. | 175/73 |
| 3,042,125 | 7/1962 | Duncan | 175/73 |
| 3,045,767 | 7/1962 | Klassen | 175/325 X |
| 3,352,370 | 11/1967 | Livingston | 175/325 X |
| 3,561,549 | 2/1971 | Garrison et al. | 175/76 |
| 4,185,704 | 1/1980 | Nixon | 175/76 |
| 4,394,881 | 7/1983 | Shirley | 175/76 |

*Primary Examiner*—Stephen J. Novosad
*Assistant Examiner*—Michael Starinsky

[57] ABSTRACT

The invention relates to a method and means for controlling the course of a bore hole during drilling thereof. The means comprises a down-hole motor and two eccentric stabilizers mounted on the housing of the down-hole motor near the ends thereof. Controlling the course of a bore hole that is being drilled with the down-hole motor driving the drill bit is done by successively not rotating the drill string and rotating the drill string.

3 Claims, 7 Drawing Figures

FIG. 1
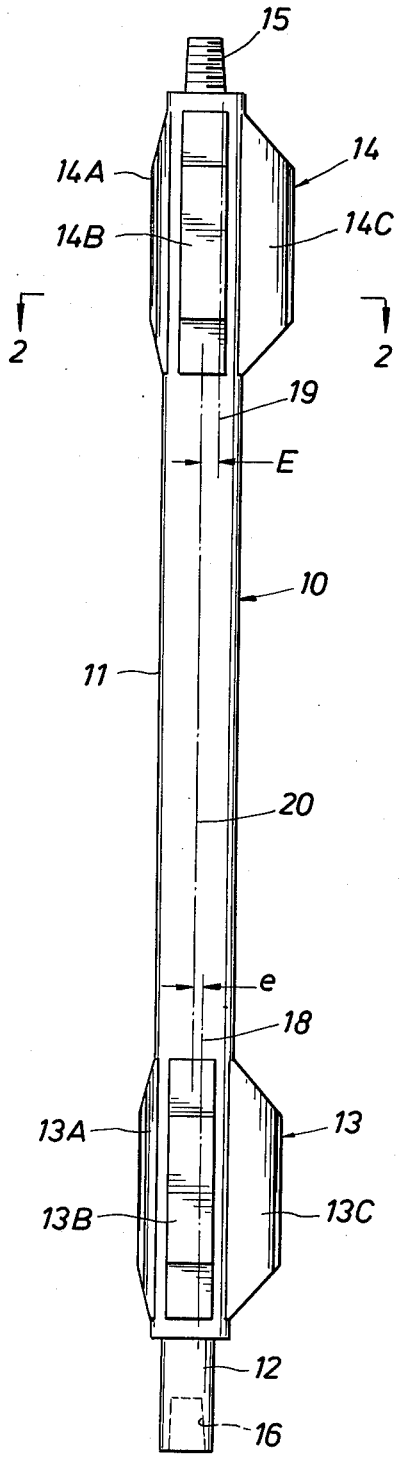
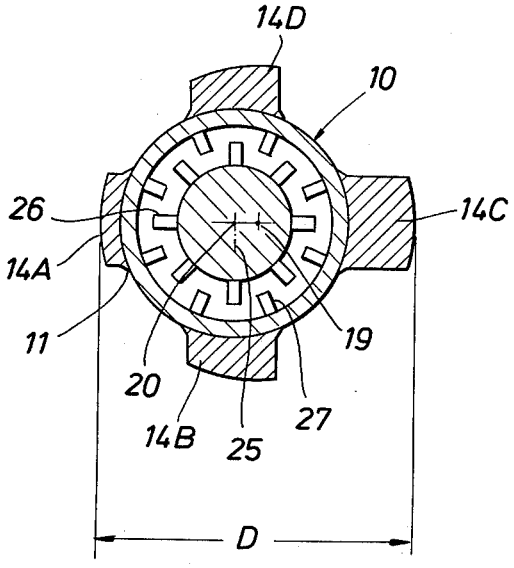
FIG. 2

METHOD AND MEANS FOR CONTROLLING THE COURSE OF A BORE HOLE

BACKGROUND OF THE INVENTION

The invention relates to drilling in underground formations in the search for valuable materials such as oil and natural gas. In particular the invention relates to a method and means for controlling the course of a bore hole during drilling thereof.

In this specification and in the claims, the expression "the course of a bore hole" refers to the azimuth of the bore hole, being the direction of the bore hole with respect to the magnetic North Pole, as well as to the deviation of said bore hole, which is the direction of the bore hole with respect to the vertical.

While drilling a bore hole in underground formations, the bore hole tends to drift away from the desired course, as a result of the reaction of the drill bit and the drill string to the formations traversed, especially if such formations are dipping formations. The bore hole is regularly surveyed in order to determine the actual course thereof and the results of these surveys are used to decide whether the course of the bore hole needs to be corrected and to determine the extent of the corrections.

In order to correct the course of a bore hole that is being drilled, means for controlling the course of such bore hole are included in the drill string. Since these means are remotely controlled, they may be included permanently in the drill string. Examples of these means are the "variable bent sub" and the "orienting tool". The variable bent sub comprises a pipe section equipped with remotely controlled servo-mechanisms capable of controlling the degree of deflexion of the pipe section. An example of a variable bent sub is described in French patent application Ser. No. 2,175,620 (filed: 16th Mar. 1972; inventor: Russel, M. K.). The orienting tool comprises a housing and shoes that can be extended laterally with respect to the housing by means of remotely controlled servo-mechanisms. Further details of the orienting tool are given in U.S. Pat. No. 3,561,549 (filed: 7th June, 1968; issued: 9th Feb. 1971; inventors Garrison, E. P. and Tschirky, J. E.).

A major disadvantage of the above-mentioned steering means resides in their complexity and the cost of the servo-mechanisms thereof.

The object of the invention is a simple and reliable method and means for controlling the course of the bore hole.

SUMMARY OF THE INVENTION

According to the invention, the method for controlling the course of a bore hole that is being drilled in underground formations by means of a drill bit driven by a down-hole motor provided with a housing and an output shaft which output shaft is in the operative position during drilling of the bore hole tilted with respect to the bore hole includes the steps of: (a) lowering in the bore hole a drill string with the down-hole motor connected to the lower end thereof and having a drill bit connected to the output shaft, (b) actuating the down-hole motor to rotate the drill bit and applying a predetermined weight on bit, and (c) simultaneously with step (b) rotating the drill string over periods that are preceded and followed by selected periods during which the down-hole motor is activated but the drill string is not rotated.

The means according to the invention for controlling the course of a bore hole during drilling thereof in an underground formation includes a down-hole motor provided with a housing and an output shaft, a first stabilizer and a second stabilizer, both stabilizers being mounted on the housing such that the first stabilizer is located nearer to the output shaft than the second stabilizer, wherein the central axes of the stabilizers are parallel to each other and at least the central axis of the second stabilizer is parallel to the central axis of the output shaft.

In this specification and in the claims, the term "stabilizer" is used to refer to a plurality of blades which project outwards from a housing or a sleeve in order to guide the housing or the sleeve in a bore hole. The expression "central axis of a stabilizer" refers to the central axis of the surface of revolution that envelopes the blades of the stabilizer, and the expression "diameter of the stabilizer" refers to the diameter of this surface of revolution.

It will be appreciated that the drill string is rotated by rotating the rotary table that is located at the drilling floor of a conventional rotary well-drilling rig. When the drill string should not rotate, drill string rotation as a result of the reaction torque of the down-hole motor is prevented by locking the rotary table.

BRIEF DESCRIPTION OF THE DRAWING

The invention will now be explained by way of example in more detail with reference to the drawings, wherein:

FIG. 1 shows a side-view of the apparatus of the present invention for controlling the course of a bore hole;

FIG. 2 shows a cross-section of FIG. 1 over the line II—II, drawn to a scale different from the scale of FIG. 1;

DESCRIPTION OF A PREFERRED EMBODIMENT

Figure 3:
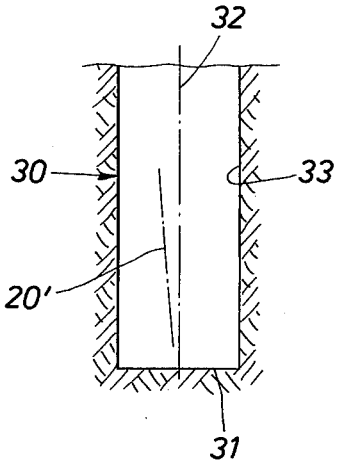
FIG. 3 is a diagrammatic view showing a longitudinal section over the lower end of a vertical bore hole.

Reference is now made to FIG. 1 showing a side-view of the means for controlling the course of a bore hole. The means includes a hydraulic turbine 10 of any type well known to be art, which is to be driven by drilling fluid that is circulated through the turbine. The turbine 10 is provided with a housing 11, an output shaft 12, a first eccentric stabilizer 13 and a second eccentric stabilizer 14. The two stabilizers 13 and 14 are mounted on the housing 11 of the turbine 10.

The upper end of the housing 11 is provided with an external tapered screw thread 15 for connecting the housing 11 to the lower end of a drill string 41 (FIG. 7) and the output shaft 12 is provided with an internal tapered screw thread 16 for connecting a drill bit 42 thereto.

The two eccentric stabilizers 13 and 14 have four blades each, of which three outwardly-extending blades are shown in FIG. 1, denoted with 13A to 13C for the first stabilizer 13 and with 14A to 14C for the second stabilizer 14. In this specification, the expression "eccentric blades" is used to refer to the blades 13C and 14C. The position of the fourth blade (not shown) of the second stabilizer 13 is consistent with the position of the fourth blade 14D (see FIG. 2) of the second stabilizer 14.

The central axis 18 of the first stabilizer 13 is parallel to the central axis 19 of the second stabilizer 14. Both central axes 18 and 19 are parallel to, and offset at distances e and E, respectively, from, the central axis 20 of the output shaft 12, which central axis coincides with the central axis of the turbine housing when the turbine is straight as shown in FIG. 1. In some cases, the distance e may be zero.

The magnitude of the eccentricity of the second stabilizer 14 is E and the magnitude of the eccentricity of the first stabilizer 13 is e, wherein E is greater than e.

Reference is now made to FIG. 2, showing a cross-section of FIG. 1 over the line II—II and drawn to a scale different from the scale of FIG. 1. The four blades 14A to 14D of the second stabilizer are welded to the housing 11 of the turbine 10. The rotor 25 of the turbine 10 is equipped with a plurality of rotor blades 26 and the housing 11 is equipped with a plurality of stator blades 27. It will be appreciated that the central axis of the rotor 25 coincides with the axis 20 of the output shaft.

The diameters D of the stabilizers 13 and 14 are substantially equal to each other. To allow passing of the stabilizers through the bore hole, the diameter D of the stabilizers is less than the diameter of the bore hole cut by a drill bit attached to the lower end of the output shaft 12.

When using the turbine shown in FIG. 1 for controlling the course of a bore hole in an underground formation, a drill bit is connected to the output shaft of the turbine and the turbine/drill bit assembly is connected to the lower end of a drill string and lowered in a bore hole until the drill bit is on the bottom of the bore hole. Subsequently drilling fluid is circulated through the interior of the drill string in order to actuate the turbine, and a predetermined weight is applied on the drill bit.

It will be appreciated that corrections on the course of the bore hole should be made from time to time in order to keep the bore hole on the desired course. The result of these corrections is that the bore hole will consist of straight and curved sections that succeed each other in downward direction.

With reference to FIGS. 3–7, it will be explained that with the use of the means according to the invention curved and straight sections can be drilled at will. Drilling of a curved section of the bore hole is done by rotating the drill bit with the turbine 10, and applying a predetermined weight on bit, and simultaneously therewith not rotating the drill string and the turbine body connected thereto at the lower end thereof. Drilling of a straight section of the bore hole is done by rotating the drill bit with the turbine under weight and simultaneously therewith rotating the drill string.

Figure 7:
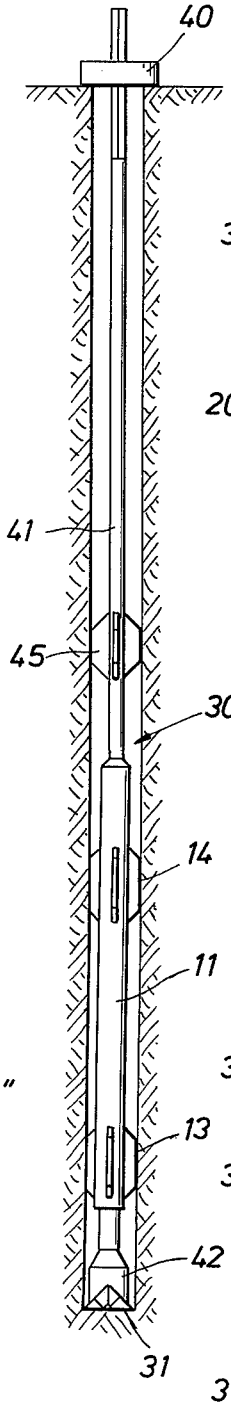
FIG. 7 is a schematic view of a well being drilled in accordance with the present invention.

The method for drilling a curved section of the bore hole will now be explained with reference to FIG. 3 showing a longitudinal section over the lower end of a vertical bore hole that is to be extended with a curved section (see FIG. 4) to be drilled with the means according to the invention. For the sake of ready understanding, a schematic view of a well being drilled is shown in FIG. 7 as including a rotary table 40 and a drill string assembly, consisting of a drill string 41, the turbine 10 and a drill bit 42.

Figure 4:
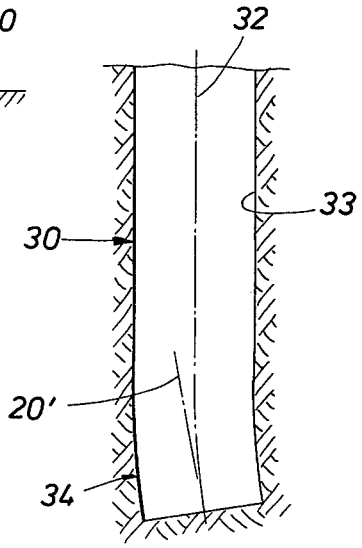
FIG. 4 is a diagrammatic view showing a longitudinal section over the lower end of the vertical bore hole of FIG. 3, but extended with a curved section that is being drilled by the method according to the invention.
Figure 5:
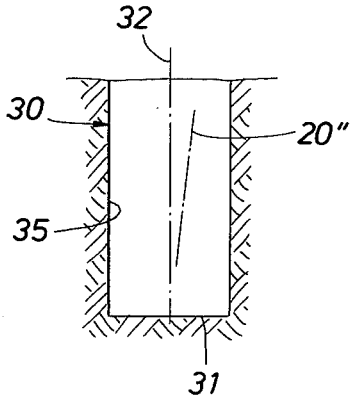
FIG. 5 is a diagrammatic view showing a longitudinal section over the lower end of a vertical bore hole.
Figure 6:
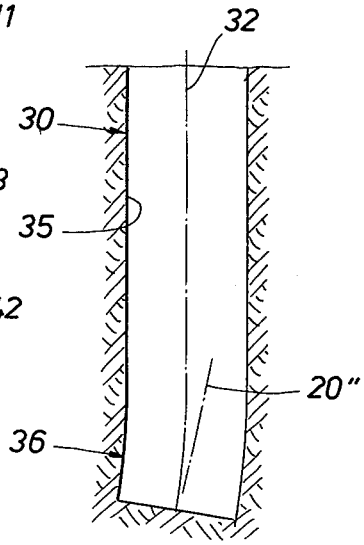
FIG. 6 is a diagrammatic view showing a longitudinal section over the lower end of the vertical bore hole of FIG. 5, but extended with a curved section in a direction opposite to the direction of the curved section shown in FIG. 4.

Reference is first made to FIG. 3. The drill string assembly has been lowered in the bore hole 30 and the drill bit 42 rests on the bottom 31 of the bore hole 30. The stabilizers 13 and 14 (see FIG. 1) will fit in the bore hole 30 and their central axes 18 and 19 (see FIG. 1) will substantially coincide with the central axis 32 of the bore hole 30. The drill string is rotated in rotary table 40 (FIG. 7) until the stabilizers are oriented such that the eccentric blades 13C and 14C thereof (see FIG. 1) are facing the east side 33 of the bore hole well. As the stabilizers are mounted eccentrically on the turbine housing and as the eccentricity E of the second (upper) stabilizer is greater than the eccentricity e of the first (lower) stabilizer, the turbine is tilted in counter clockwise direction with respect to the central axis 32 of the bore hole in such a way that the central axis of the output shaft is positioned in the position indicated by the dash-dot line 20'. As the central axis of the drill bit coincides with the central axis of the output shaft, further drilling with the turbine driven drill bit will deepen the bore hole 30 in the direction in which the central axis 20' is positioned. As the drill string, and consequently also the turbine housing are not rotated, the eccentric blades continue to face to the east side 33 of the bore hole and consequently the central axis 20' of the output shaft will stay in its deviated position with respect to the central axis 32 of the bore hole. When the bore hole is further deepened and the first lower stabilizer and subsequently the second (upper) stabilizer enter the deviated extension of the bore hole, the tilt of the turbine will increase, and further drilling results in an increasing deviation of the bore hole extension. As this interaction between the deviated bore hole and the tilted turbine continues, a curved section of the bore hole having a gradually increasing curvature is drilled. A longitudinal section over the lower end of the straight bore hole 30 extended with a curved section 34 is shown in FIG. 4. The azimuth of the curved section 34 is the azimuth of the eccentric blades.

When the drill string 41 is lowered in the bore hole 30 and when the drill string is rotated until the eccentric blades face the west side 35 (see now FIG. 5) of the bore hole 30, the turbine tilts in opposite direction such that the central axis of the output shaft (and consequently also the central axis of the bit) will coincide with the axis 20''. Further drilling with the turbine driven drill bit without simultaneously rotating the drill string will result in drilling a curved section 36 of the bore hole (see FIG. 6). Since the eccentric blades are facing the west side 35 of the bore hole, the section 36 curves in a direction opposite to the curved section 34 (see FIG. 4). The deviation of the curved section 36 increases with increasing depth and the azimuth of the curved seciton is the azimuth of the eccentric blades.

As discussed with reference to FIGS. 3–7, the azimuth of a curved section is the azimuth of the eccentric blades. Hence a curved section of a bore hole can be drilled in any desired direction by rotating the drill string until the eccentric blades are positioned in the desired direction.

The curved section 34 (see FIG. 4) has been drilled with the eccentric blades facing the east side 33 of the bore hole. If after drilling of the curved section 34 the drill setring is rotated or moved over an angle of 180°, the eccentric blades will face the west side of the bore hole. Further drilling with the eccentric blades facing west will result in drilling a section that is curved in the same direction as the section 36 (see FIG. 6). After another 180° movement or rotation of the drill string, the eccentric blades will point again to the east side of the bore hole, and further drilling will result in drilling a section that is curved in the same direction as the section 34 (see FIG. 4). When the drill string is rotated over 180° at regular intervals during drilling of the bore hole, it will be appreciated that the bore hole will proceed in a downward direction. However, such a bore hole is not straight as it consists of a series of curved sections. Continuous rotation of the drill string by the rotary table 40 (FIG. 7), however, which rotation takes place simultaneous with the rotation of the drill bit actuated by the turbine will result in a straight hole.

It will be appreciated that the curved or straight sections drilled with the method according to the invention may be drilled as an extension of an existing hole of which the lower end is curved and/or deviated from the vertical instead of being vertical as shown in FIGS. 3–7. In addition thereto, the existing hole may have been cased.

The method for drilling curved and straight sections of a bore hole allows drilling a bore hole that consists of a sequence of curved and straight sections. Thus the means according to the invention is sued to control the course of a bore hole, and drilling of such a bore hole with a turbine driven drill bit is done by rotating the drill string from rotary table 40 over periods that are preceded and followed by selected periods during which the turbine drives the drill bit but the drill string is not rotated.

Although drilling curved and straight sections of a bore hole by means of a turbine equipped with two eccentric stabilizers as shown in FIG. 1 will give good results, even better results will be obtained when the lower end of the drill string is centralized in the bore hole by means of a concentric stabilizer 45 inserted in the lower part of the drill string at some distance above the turbine.

There is a tendency to increase the length of turbines in order to increase the power thereof. It will be appreciated that these long turbines are more slender than the relatively short turbine that is shown in FIG. 1. For relatively long turbines, two eccentric stabilizers mounted on the housing thereof may often not be sufficient and it will then be attractive to mount the second eccentric stabilizer near the middle of the turbine housing and to place a third stabilizer concentrically at or near the upper end of the housing.

In the arrangement shown in FIG. 1, the first (lower) stabilizer 13 is placed eccentrically with respect to the central axis of the output shaft 12 of the turbine 10. This is done to avoid drilling of oversized holes. When oversized holes are not considered to have adverse effects on drilling and subsequently completing the bore hole, the lower stabilizer may be placed concentrically with respect to the output shaft.

The method for controlling the course of a bore hole as described with reference to the FIGS. 3–7 is not restricted to the use of the means according to the invention as shown in FIGS. 1 and 2 of the drawings. If desired, the method can also be applied by using any one of those drilling means including a turbine driving a drill bit and having the output shaft thereof tilted with respect to the central axis of a bore hole during drilling thereof.

The invention is not restricted to the application of stabilizers with four straight blades. Any other type known in the art such as stabilizers with spiral shaped blades may be applied. The blades may be provided with wear resistant inserts to minimize wear of the blades.

Also, the invention is not restricted to the application of stabilizers that are directly connected to the housing of the down-hole motor. If desired, the stabilizers may be mounted on a sleeve that fits around the housing of the down-hole motor, which sleeve is secured in a suitable manner to the housing of the down-hole motor in order to prevent axial and rotational displacement of the sleeve with respect to the housing of the down-hole motor. Such construction is disclosed in French patent application No. 1,593,999 (filed: Dec. 4, 1968; issued; July 10, 1970; inventor: Tiraspolsky, W.), and therefore no details of this construction will be given here.

Further, the invention is not restricted to the use of three stabilizers. Each stabilizer may be replaced by a group of two or three stabilizers that are interlinked.

Finally, the invention is not restricted to a hydraulically driven turbine. Any down-hole motor known in the art such as a vane motor, a MOINEAU MOTOR (also referred to as Mono-motor), and an electric motor may be used.

We claim as our invention:

1. Means for controlling the course of a bore hole that is being drilled in underground formations, which means forms a drilling assembly and includes a down-hole motor provided with a housing and an output shaft, a first rigid eccentric stabilizer and a second rigid eccentric stabilizer, both stabilizers being mounted on the housing such that the first stabilizer is located nearer to the output shaft than the second stabilizer, wherein the central axes of the stabilizers are parallel to each other and offset from the central axis of the output shaft in the same direction, the axis of the first eccentric stabilizer being offset from the axis of the output shaft a distance less than the offset of the axis of the second excentric stabilizer.

2. Means according to claim 1, wherein the second stabilizer is positioned near the end of the housing that is opposite to the end of the housing from which the output shaft protrudes.

3. Means according to claim 1, wherein a third stabilizer, having a central axis coinciding with the central axis of the output shaft, is positioned in said drilling assembly near the end of the housing opposite to the end of the housing from which the output shaft protrudes, and wherein the second eccentric stabilizer is arranged between the first and the third stabilizer.

* * * * *